United States Patent [19]

Tominaga

[11] 4,456,147

[45] Jun. 26, 1984

[54] AUTOMATIC VENDING MACHINE

[75] Inventor: Hiroshi Tominaga, Kawasaki, Japan

[73] Assignee: Fuji Electric Co., Ltd., Kawasaki, Japan

[21] Appl. No.: 323,385

[22] Filed: Nov. 20, 1981

[30] Foreign Application Priority Data

Nov. 26, 1980 [JP] Japan ..... 55/166243

[51] Int. Cl.[3] ..... B65G 59/06

[52] U.S. Cl. ..... 221/67; 193/32; 211/49 D

[58] Field of Search ..... 221/67, 295, 307, 310, 221/107-109, 308; 211/162, 49 D; 312/124; 193/25 E, 25 S, 32

[56] References Cited

U.S. PATENT DOCUMENTS

| | | | |
|---|---|---|---|
| 2,500,503 | 3/1950 | Albertoli | 193/32 X |
| 2,818,978 | 1/1958 | Post | 211/49 D |
| 3,306,688 | 2/1967 | Di Domenico | 211/49 D |
| 3,662,[illegible]98 | 5/1972 | Baxendale | 211/49 D |
| 3,938,700 | 2/1976 | Camp et al. | 221/109 |

FOREIGN PATENT DOCUMENTS

| | | | |
|---|---|---|---|
| 660426 | 5/1938 | Fed. Rep. of Germany | 193/32 |

*Primary Examiner*—Stanley H. Tollberg
*Attorney, Agent, or Firm*—Bruce L. Birchard

[57] ABSTRACT

By displaceably, rather than fixedly, supporting selected track segments in the gravity-fed storage chamber of an automatic vending machine, the kinetic energy developed in the stored goods as they fall in the storage chamber is dissipated by the displaceable track segments in a damping fashion and the goods are not subject to shock and damage.

6 Claims, 5 Drawing Figures

AUTOMATIC VENDING MACHINE

BACKGROUND OF THE INVENTION

1. Field of the Invention

This invention relates to automatic vending machines.

2. Prior Art

Prior art vending machines have had vertical goods storing chambers of a serpentine type in which the successive segments, which may have been of an arcuate shape, oppositely facing, were fixed in position with respect to each other. Goods were fed in at the top of the chamber and were released, sequentially, from the bottom of the chamber by the deposit of a coin, for example. During the loading of the storage chamber, the goods, for example bottles or cans, fall, by reason of gravity, to the lowest available space in the storage chamber. During the falling process they accelerate and, with conventional storage chambers, may reach velocities such that they are destroyed when they hit an obstruction in the chamber, for example, the last previously stored bottle or can. Bottles, particularly, are often broken in the process of loading conventional storage chambers in vending machines.

SUMMARY OF THE INVENTION

Therefore, it is an object of this invention to avoid the problems of prior art vending machines.

It is a further object of this invention to provide an automatic vending machine in which storage of the goods to be vended is achieved without damage to the goods.

Stated succinctly, the foregoing objects are met by rotatably supporting, from mixed portions of the vending machine, the upper ends of selected track segments in a vertically disposed, serpentine storage chamber. Thus, such segments may rotate about their supporting axis in response to being struck by goods being loaded. Spring biasing of the segments in a direction opposite to the direction of forces generated by falling goods, such as cans, results in dissipation of the kinetic energy inherent in the falling goods as the goods strike the displaceable segments during the loading process. The kinetic energy is absorbed in the springs, the goods are slowed in their descent, and damage of the goods is prevented.

Instead of using springs to dissipate the kinetic energy, a bumper member of rubber, or the like, with energy-dissipating characteristics may be provided to be engaged by a displaceable segment when it is hit by a falling can, or other goods, in the storage chamber.

As another alternative, a weight, of pre-determined mass, is added to the rotatable or displaceable segment. The mass or weight may be made such that the effective mass of the segment and weight substantially equals the mass of each item of the goods being stored. Then the falling goods can transfer the energy into the rotating segment and the result will be reduced speed and reduced destruction of the goods.

BRIEF DESCRIPTION OF THE DRAWINGS

The invention can best be understood by referring to the discussion which follows taken in conjunction with the accompanying drawings, in which.

DETAILED DESCRIPTION OF THE PREFERRED EMBODIMENT

Figure 1:
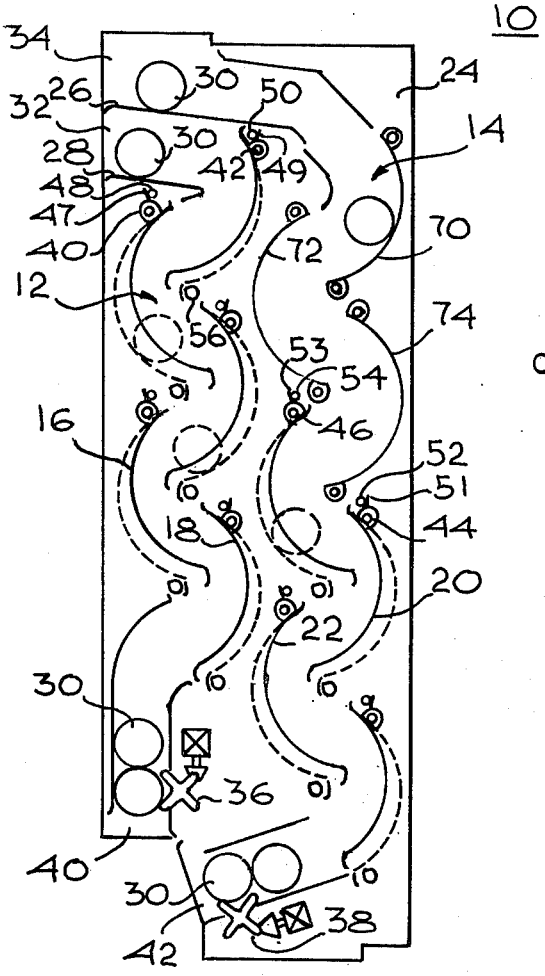
FIG. 1 is an elevational view, partially schematic in nature, of one embodiment of the invention.

In FIG. 1, vending machine 10 includes a pair of serpentine goods-storage chambers 12 and 14, each made up of a series of track segments 16, 18 and 20, 22. These track segments are arcuate in configuration and the concave surface of the arcuate tracks is the surface on which the goods, for example cans, roll. The closing of the space in the serpentine chambers is effected by a pair of side plates, only one of which, side plate 24, is shown in FIG. 1, the other, being normally located toward the viewer of FIG. 1, having been removed to disclose the nature of chambers 12, 14.

Trays 26 and 28 are provided at the upper ends of chambers 14 and 12, respectively, to permit introduction of goods 30, into the respective chambers.

Openings 32, 34 in vending machine 10 permit loading of goods into chambers 12, 14, respectively.

Dispensing of goods 30 from the vending machine 10 is effected by mechanisms 36, 38, which may be solenoid operated in a manner well known in the art. Goods 30 are dispensed through outlets 40, 42, respectively.

When the goods 30 are introduced into storage chambers 12 and 14, respectively, particularly when vending machine 10 is initially being loaded, the goods may fall a considerable distance within chambers 12 and 14, respectively, and in such falling, gain speed and kinetic energy which can cause damage to the goods if all the energy is consumed in colliding with the fixed elements of the chamber or other goods that have already been loaded.

To avoid this problem, track segments 16 and 18, and 20 and 22 are shown supported on pivot pins 40, 42, 44, and 46, respectively. The pivot pins are supported horizontally in sideplate 24 and its counterpart, not shown. The track segments 16, 18, 20 and 22, in addition to being supported on their respective pivot pins, may be biased into the solid line positions shown in FIG. 1, by means of helical springs 47, 49, 51 and 53 wound about their respective pivot pins and having one end bearing on respective stop members 48, 50, 52 and 54, the details of which can be seen more clearly in the representative structure of FIG. 2.

An additional track-segment motion-limiting member 56 may be provided for each pivotable track segment, such as segment 18. Member 56 is supported between the side plates 24 and its opposite member, not shown.

When goods 30 are loaded onto sloped tray 28 through opening 32 they encounter track segment 18 and, because the goods have acquired kinetic energy "B", they move segment 18 about pivot pin 42 against the force "A" of spring 49 until segment 18 strikes limiting element 56. The kinetic energy of goods 30 is thus transferred to store energy in spring 49 and goods 30 are slowed in their descent through chamber 14 and damage to goods 30 is avoided.

The positioning of limiting element 56 is such that when segment 18 engages limiting element 56 (the dotted-line position in FIG. 1), the width of the passage formed by segments 16 and 18 is of a predetermined value corresponding to the diameter of the goods 30.

Figure 2:
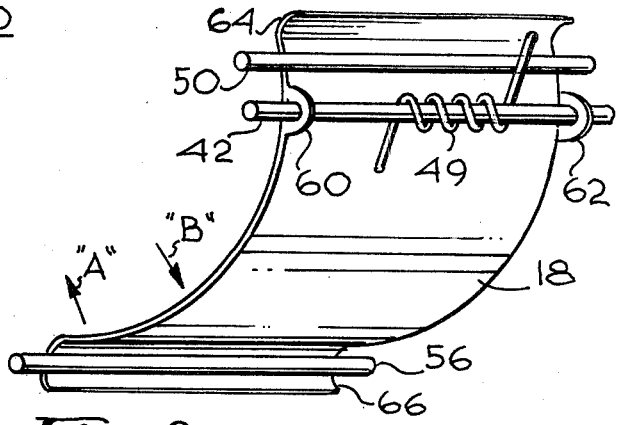
FIG. 2 is an isometric view of a displaceable segment for use in the structure of FIG. 1.

Pivot pin 42 engages and supports segment 18 through ears 60, 62. The upper and lower ends 64, 66 of each track segment represented by segment 18, may be bent, as shown in FIG. 2, to cooperate with stop or limiting members 50, 56.

As is indicated in FIG. 1, not all track segments in a storage chamber need be pivotable or displaceable. In chamber 14, selected segments (for example, segments 70, 72) are fixed and segments 20, 22 are pivotable. Also, a fixed segment 74 may face and cooperate with a pivotable segment 22 (FIG. 1).

Figure 3:
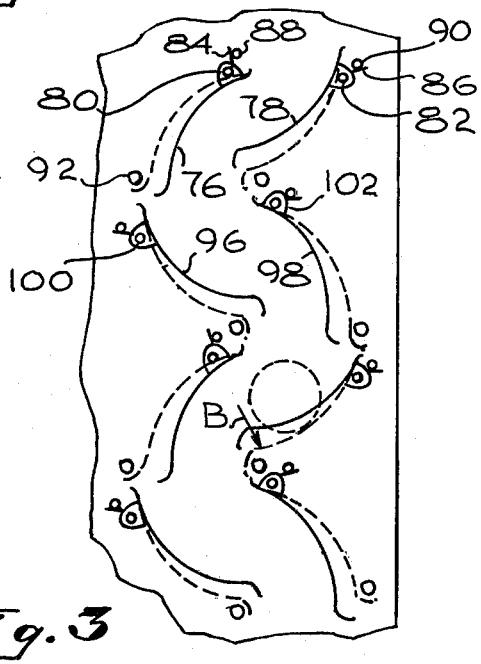
FIG. 3 is a schematic diagram of an alternative form of a displaceable structure for use in the structure of FIG. 1.

Further, as is shown in FIG. 3, the pivotable track segments may be directly opposite each other, i.e., pivot pins 80 and 82 may be substantially horizontally aligned, to form an arcuate path, rather than staggered vertically (or "zig-zagged") as shown in FIG. 1. Spring biasing is provided as before by springs 84, 86. Limiting or stop members 88, 90, 92 and 94 are also provided, as before.

Segments 96, 98, of opposite curvature to segments 76, 78, are similarly pivotably supported by pivot pins 100, 102, respectively, and spring biased to the solid line positions.

Figure 4:
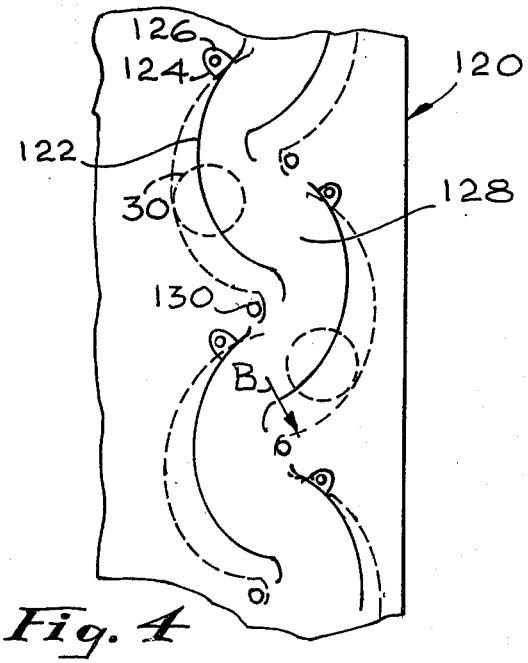
FIG. 4 is a schematic diagram of an additional alternative form of a track segment for use in the structure of FIG. 1; and, FIG. 5 is a view showing weights attached to the segments.

In the storage chamber 120 of FIG. 4, track segment 122 is hung on pivot pin 124 in freely pivoting fashion, by means of ears 126. The center of gravity of track segment 122 is just below pivot pin 124 and, as a result, track segment 122, in its free-hanging position, tilts to the solid-line position shown in FIG. 4, which is in the line of travel of goods 30 through space 128. Goods 30, when falling through space 128, encounter segment 122 and push it toward limit element 130. In this embodiment, the mass and inertia-of-rest of segment 122, itself, is used to dissipate the kinetic energy of goods striking it, thus preventing destruction of the goods. By this method, the spring 49 of FIG. 2 has been eliminated.

Figure 5:
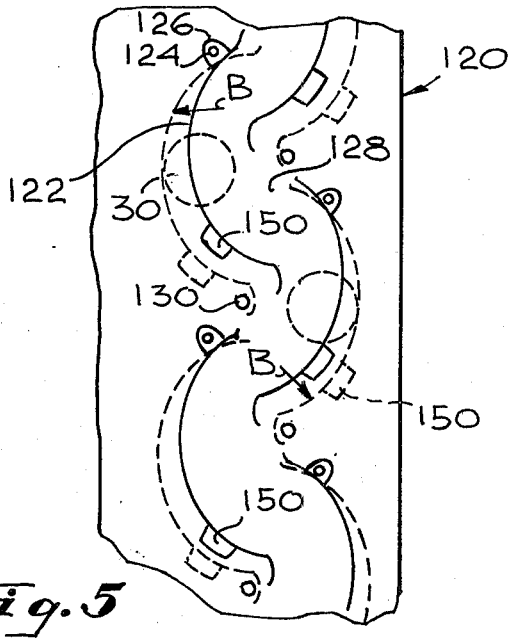

If goods 30 are of more than minor weight or mass, the mass of segment 122, by itself, will not be great enough to dissipate the kinetic energy of the falling goods. Thus, the embodiment of FIG. 5 may be necessary. In FIG. 5, a weight, 150, has been added to segment 122 to increase its inertia of rest. By making the mass of weight 150 plus that of segment 122 approximately equal to the mass of goods 30, thorough dissipation of the kinetic energy of goods 30 can be achieved as segment 122 is forced to the dotted line position shown in FIG. 5.

A combination of spring and mass energy absorption may be used.

While particular embodiments have been shown and described, it will be apparent to those skilled in the art that variations and modifications hereof may be made without departing from the spirit and scope of this invention. It is the intention of the appended claims to cover all such modifications and variations.

I claim:

1. A machine for automatically dispensing, goods, including:

a serpentine-shaped vertical storage chamber for said goods, said chamber having an inlet and an outlet;

said serpentine-shaped vertical storage chamber being formed by a series of vertically disposed, individually supported, horizontally-spaced and opposed arcuate track segments and a cooperating pair of side-plates;

selected ones of said track segments being pivotally supported at their upper ends for rotation when engaged by said goods;

said horizontally-spaced track segments being directly opposed.

2. A machine for automatically dispensing goods, including:

a serpentine-shaped vertical storage chamber for said goods, said chamber having an inlet and an outlet;

said serpentine-shaped vertical storage chamber being formed by a series of vertically disposed, individually supported, horizontally-spaced and opposed arcuate track segments and a cooperating pair of side-plates;

selected ones of said track segments being pivotally supported at their upper ends for rotation when engaged by said goods;

said machine including, in addition, stop means supported proximate to the lower portion of each of said selected ones of said track segments for limiting the displacement thereof.

3. A machine for automatically dispensing goods, including:

a serpentine-shaped vertical storage chamber for said goods, said chamber having an inlet and an outlet;

said serpentine-shaped vertical storage chamber being formed by a series of vertically disposed, individually supported, horizontally-spaced and opposed arcuate track segments and a cooperating pair of side-plates;

selected ones of said track segments being pivotally supported at their upper ends for rotation when engaged by said goods;

said horizontally-spaced track segments being partially opposed.

4. A machine for automatically dispensing goods, including:

a serpentine-shaped vertical storage chamber for said goods, said chamber having an inlet and an outlet;

said serpentine-shaped vertical storage chamber being formed by a series of vertically disposed, individually supported, horizontally-spaced and opposed arcuate track segments and a cooperating pair of side-plates;

selected ones of said track segments being pivotally supported at their upper ends for rotation when engaged by said goods;

said selected ones of said track segments being pivotally supported above and proximate to their respective centers of gravity and each having a mass approximating that of one item of said goods, whereby selected ones of said arcuate track segments hang into the normal passage for said goods and dissipate the kinetic energy of each unit of said goods as it moves through such passage.

5. Apparatus according to claim 4 which includes, in addition, a weight attached to each of said selected ones of said track segments to increase the effective mass of each such track segment.

6. A machine for automatically dispensing goods, including:

a serpentine-shaped vertical storage chamber for said goods, said chamber having an inlet and an outlet:

said serpentine-shaped vertical storage chamber being formed by a series of vertically disposed, individually supported, horizontally-spaced and opposed arcuate track segments and a cooperating pair of side-plates;

selected ones of said track segments being pivotally supported at their upper ends for rotation when engaged by said goods;

said machine including, in addition, spring means coupled to said selected ones of said track segments for biasing said selected ones of said track segments towards said opposed arcuate track segments and into the path of said goods;

the mass of each of said selected ones of said track means in combination with the force of said biasing spring approximating the force exerted by units of said goods passing through said storage chamber.

* * * * *